United States Patent [19]

Wilson

[11] Patent Number: 4,787,671

[45] Date of Patent: Nov. 29, 1988

[54] FOLDING 3-PIECE CHAIR WITH LINK CONTROL

[75] Inventor: Michael C. Wilson, Glen Ellyn, Ill.

[73] Assignee: The Tyke Corporation, Chicago, Ill.

[21] Appl. No.: 17,331

[22] Filed: Feb. 20, 1987

Related U.S. Application Data

[63] Continuation-in-part of Ser. No. 895,054, Aug. 11, 1986, abandoned.

[51] Int. Cl.[4] ..... A47C 4/00

[52] U.S. Cl. ..... 297/35; 297/38; 160/DIG. 15

[58] Field of Search ..... 297/55, 56, 57, 58, 297/226, 35; 160/DIG. 15, 387, 388, 389, 390

[56] References Cited

U.S. PATENT DOCUMENTS

| | | | |
|---|---|---|---|
| 404,589 | 6/1889 | Batt | 297/38 X |
| 1,876,549 | 9/1932 | Bales | 297/55 X |
| 2,266,466 | 12/1941 | Linder | 160/DIG. 15 |
| 2,812,801 | 11/1957 | Heyman | 297/39 |
| 2,845,993 | 8/1958 | Eads et al. | 297/35 |
| 3,334,943 | 8/1967 | Ernst | 297/35 |
| 4,614,377 | 9/1986 | Luo | 297/35 |

FOREIGN PATENT DOCUMENTS

| | | | |
|---|---|---|---|
| 820791 | 11/1937 | France | 297/56 |

*Primary Examiner*—James T. McCall

*Attorney, Agent, or Firm*—Cook, Wetzel & Egan, Ltd.

[57] ABSTRACT

A folding chair has three U-shaped frame members supporting the seat and back rest and providing arm supports, and two connecting links controlling folding and unfolding for storage and use. Flexible material for the seat and back rest is removably attached to two cross members and to one frame member. Two frame members which form the legs cross and are pivoted together at the sides of the chair, and fold or scissor together front-to-back for folding and storage of the chair. The base of the U of the third frame member in a use position extends across the chair behind the back rest, and the sides form arm rests and extend forwardly to pivot connections at the front of the chair. A pair of links joins and supports the arms adjacent the rear frame member. For storage, the arm frame moves rearwardly and down about the links, folding the two leg frames together until the front pivot connections pass behind the back rest. The arm frame and links lock the first and second leg frame members together. The chair can stand upright on its legs in its folded position.

21 Claims, 2 Drawing Sheets

FIG. 5
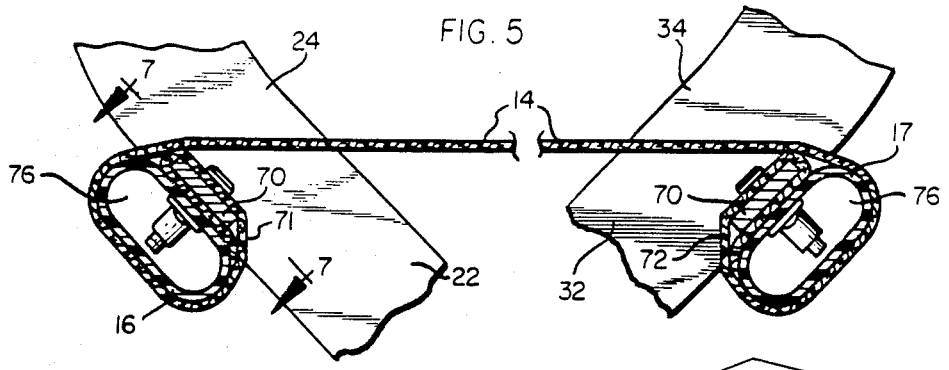
FIG. 6
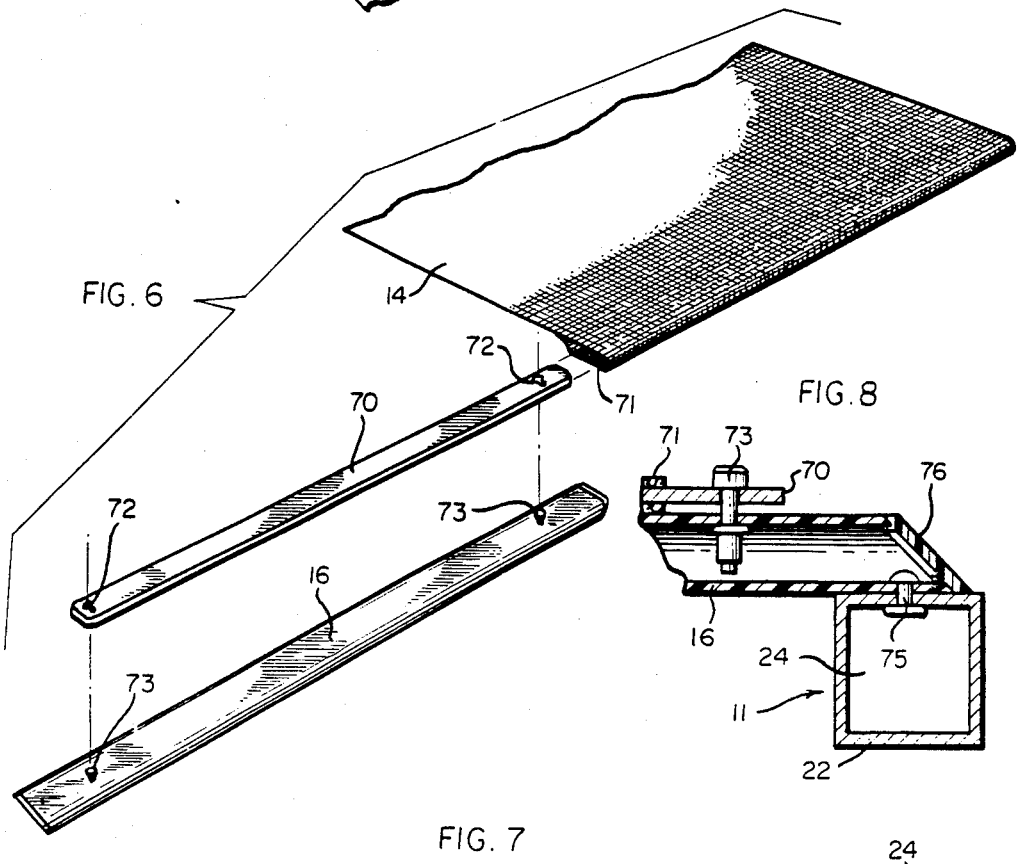
FIG. 8
FIG. 7
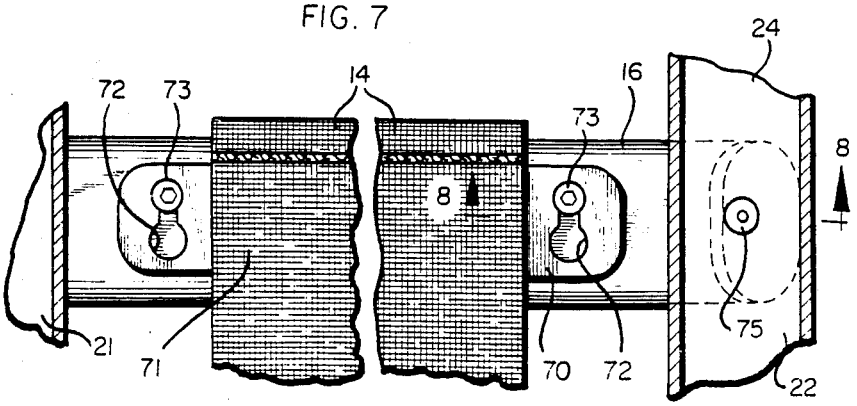

FOLDING 3-PIECE CHAIR WITH LINK CONTROL

The present invention is a continuation-in-part of my prior, co-pending application Ser. No. 895,054, filed Aug. 11, 1986, to be abandoned.

The present invention relates generally to folding or collapsible furniture and more particularly to folding chairs of the director style having crossed legs, arm rests, and a back support.

Prior art directors' chairs typically require disassembly of several pieces and a complex folding sequence for moving between a use position and a storage position. For instance, chairs with legs crossed at the front and rear have arm supports which fold sidewardly of the chair, capturing the seat fabric beneath them and in turn being held in the upright position by a back rest fabric looped over upstanding posts at the rear of the arm rests. The chair of my U.S. Pat. No. Des. 268,630 folds from side to side, but has no structure above the level of the arm rests to interfere with the folding-together of the arms. Other forms of chairs have flexible seats and backs on rigid frames which fold with their arms in a front to rear collapsing movement. Other forms of furniture and chairs fold in various ways, but none is known to have the particular features and advantages of the present invention. For instance, U.S. Pat. Nos. 2,812,801 and 3,334,943 disclose folding chairs with five-piece frames. The '801 patent shows links 43, but they join and control different parts than the links herein.

The present invention is characterized in its great simplicity, in that a chair is provided having only three distinct frame members, pivoted together for easy movement between open (use) and closed (storage) positions. In its broadest form, the invention comprises having arm rests pivotally connected to the front of the chair, adapted to pivot rearwardly and downwardly under control of links to the rear leg frame, as the chair is folded, and then to pivot downwardly to lock the front and rear frame members together in the closed or storage position. In more detailed forms, the invention comprises the layout and arrangement of the three frame members and the links, and the pivoting and folding parts and arrangements, as disclosed and shown herein. A novel attachment of the seat fabric to the support members is also shown.

In the drawings, FIG. 1 is a general perspective view of a chair embodying the invention, from the right front and above the chair, in the open position for use;

FIG. 5 is a side elevation view, partly in section, taken on line 5—5 of FIG. 1;

FIG. 6 is an exploded perspective view of seat fabric attachment means of the present invention;

FIG. 7 a top elevation view, partly in section, taken on line 7—7 of FIG. 5; and FIG. 8 is a transverse sectional view, taken on line 8—8 of FIG. 7.

Figure 1:
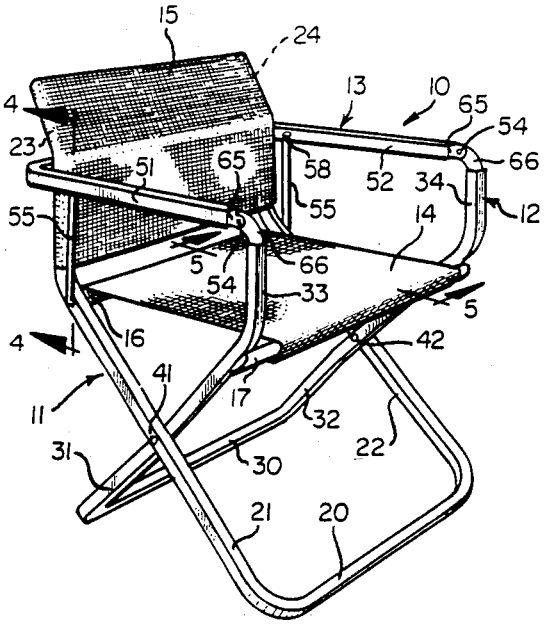
Figure 3:
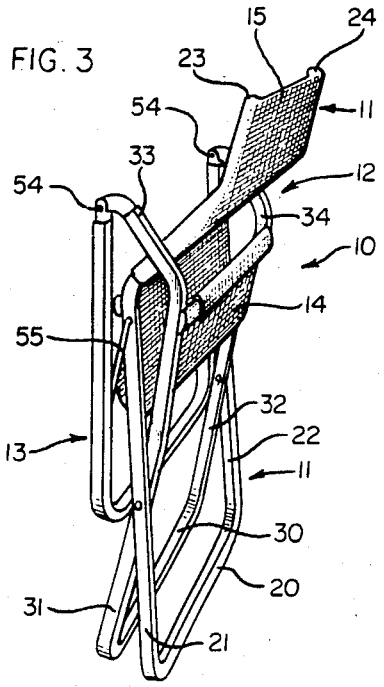
FIG. 3 is a general perspective view similar to FIG. 1 but showing the chair in its fully folded or closed position for storage.
Figure 4:
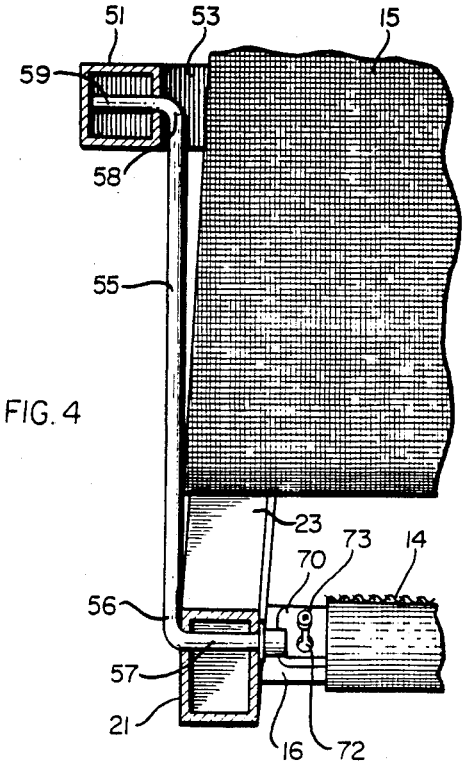
FIG. 4 is a partial front elevation view of the link detail of the chair, taken on line 4—4 of FIG. 1.

One form of chair embodying the present invention is shown at 10 in FIG. 1 of the drawings. The chair 10 comprises only three frames: a first, rear frame 11; a second, front frame 12 (rear and front are taken at seat-height); and a third, arm rest frame 13. The chair 10 has a front, rear, and sides, and is foldable between an open, use position as shown in FIG. 1 and a closed or folded, storage position as shown in FIG. 3. The first and second frames 11 and 12 support a seat 14, and the first frame 11 also supports a back rest 15. The seat 14 and back rest 15 are preferably formed of durable cloth or other flexible sheet or strip material. The seat 14 is carried on and between bars 16 and 17 extending between the sides of the first and second frames 11 and 12, as is described more fully below. The back rest 15 extends between upright ends of the rear frame 11, which ends are received in sleeves formed in the ends of the material of the back rest 15.

The first, rear frame 11 in the form shown comprises a front, lower cross piece 20 extending from one side of the chair to the other and parallel to a front edge of the seat 14. The front lower cross piece 20 is spaced a distance from the front edge of the seat 14 which is smaller in the open position of FIG. 1 than in the closed or folded position of FIG. 3. The first frame 11 also comprises a pair of lower side pieces 21, 22 which join at front lower corners of the chair to the front lower cross piece 20 and extend diagonally upwardly and rearwardly at the sides of the chair to the rear edge of the seat 14. A pair of upper rear side pieces 23, 24 are each joined to the corresponding lower side pieces 21, 22 and extend upwardly along side edges of the back rest 15 to the top of the back rest. Finally, the rear cross piece 16 extends across the first frame between the junctions of the lower and upper side pieces 21, 23; 22, 24 at either side of the chair, and supports the rear edge of the seat 14.

The second, front frame 12 is formed with a rear lower cross piece 30 which extends from one side of the chair to the other, parallel to the rear edge of the seat 14. The rear lower cross piece 30 is spaced a lesser distance from the rear of the seat 14 in the open position of the chair as shown in FIG. 1 and a greater distance in the folded position of the chair, in FIG. 3. The second frame 12 further comprises a pair of lower side pieces 31, 32 joined to the rear lower cross piece 30 and extending diagonally upwardly and forwardly therefrom at the sides of the chair to the front edge of the seat 14. A pair of front upper side pieces 33, 34 are joined to the corresponding lower side pieces 31, 32, and each extends upwardly, above the level of the seat 14, to a free end as shown. Finally, the front cross piece 17 extends between the junctions of the lower and upper side pieces 31, 33; 32, 34 at either side of the chair, for supporting the front edge portion of the seat 14.

Figure 2:
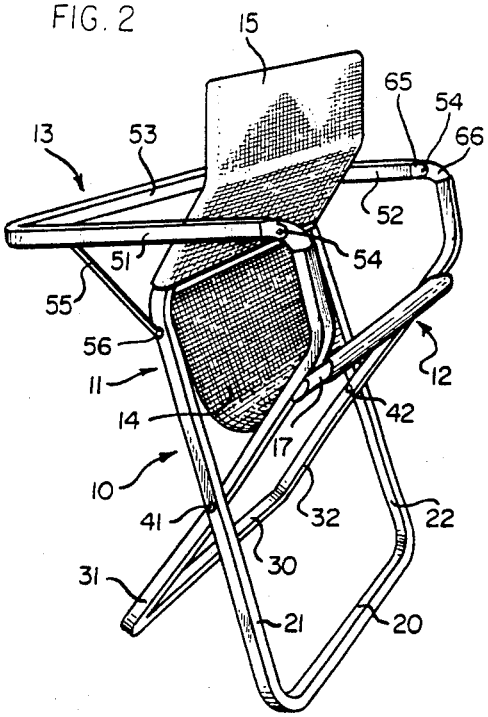
FIG. 2 is a perspective view similar to that of FIG. 1 and showing an intermediate stage of folding or unfolding the chair, between its use and storage positions.

As is shown in drawing FIGS. 1–3, the corresponding lower side pieces 21, 31; 22, 32 of the first and second frames are pivotally joined to one another at co-linear connections 41, 42 extending transversely of the chair 10, at approximately the middle of each of the side pieces. These connections allow the first and second frames 11, 12 to fold or scissor with respect to each other, in moving from the open position of FIG. 1 to the closed position of FIG. 3 and vice versa.

The third frame member 13 comprises a pair of elongated side pieces 51, 52 and a rear cross piece 53 joined to them. Each of the elongated side pieces 51, 52 is pivotally joined at its front end to one of the free ends of the upper side pieces 33, 34 of the second frame member 12, at pins 54 extending along a transverse axis.

Each of the side pieces 51, 52 of the third frame 13 extends along the sides of the chair and is shown as approximately horizontal and parallel to the side edges of the seat 14 in the open position of the chair. The shape of the back rest supports 23, 24 and the tightness of the back rest material 15 are such that a user will not feel or rest against the cross-piece 53.

Each of the side pieces 51, 52 is supported and fixed in the open or use position of the chair by a connecting link 55. The link 55 extends from a first end 56 formed with an axle 57 extending along and pivoted on a transverse axis through the upper part of the lower side member 21. A second end 58 of the link 55 is formed with an axle 59 extending along and pivoted on a parallel, transverse axis through an inner side of the arm 51. The length of the link 55 and the locations of its pivot axles 57, 59 on the leg frame 11 and the arm frame 13 are important to the functioning of the chair. In one embodiment, the link 55 is about half the length of the distance from the upper axle 59 to the front pivot 54. The lower axle 57 is located just below the level of the seat 14, and the link 55 is inclined forwardly from the vertical in the open position of the chair 10, but preferably less than about 10 degrees. The chair frames are locked into the open position even as against a user's leaning forward or back in the seat so hard as to lift the arm piece 30 or the front arm piece 20 off the floor or ground. If the link 55 were relocated to the vertical or to a rearward inclination, the chair would tend to fold upon such leaning forward or back. If the link 55 were relocated to raise its lower axle 57 above the level of the seat and/or to incline the link more than about 30 degrees from the vertical, the arms would tend to feel springy rather than stiff to a user of the chair.

As is shown in FIGS. 2 and 3, the side pieces 51, 52 of the third frame member 13 pivot past and behind the upper rear side pieces 23, 24 of the first frame member 11 in folding the chair. The third frame member 13 pivots rearwardly as the link 55 rotates about the link-/leg axle 57 and as the arms also rotate and move about both the link/arm axle 59 and the forward pivot pins 54 at the junction of the arms 51, 52 and the forward frame pieces 33, 34. The third frame member 13 pivots downwardly and hangs behind the folded chair 10 upwardly adjacent the lower cross pieces 20, 30 of the first and second frame members 11, 12, to lock the chair in its fully closed position. It is a feature of the invention that the chair will stand upright on its own feet on a level surface, whether open or fully or partly closed.

Each forward pivot pin 54 is carried on fitments 65, 66, attached respectively to the arm rest 51 or 52 and the upper front side member 33 or 34. Where the frame members are formed of vinyl-covered tubular metal, the fitments 65 and 66 conveniently pass into the interiors of the tubular members. The exposed portions of the fitments 65, 66 may be of any exterior configuration, so long as they can pass without interference past and behind the upper rear side pieces 23, 24 and the back rest 15, in moving between the FIGS. 2 and 3 positions.

As is shown in FIGS. 5-8, the seat 14 is stretched between and removably attached to the rear and front cross members 16, 17 by means of retaining bars 70 received in fabric loops 71, 72 formed at the rear and front of the seat material 14. Each retaining bar 70 is formed with a pair of keyholes 72 near either end thereof, having an enlarged circular portion and a narrow slot extending therefrom. Headed studs 73 are carried on the bars 16 and 17 at the same spacing along the bars 16 and 17 as the spacing of the keyholes 72 on the bars 70. That spacing is slightly greater than the width of the seat 14 at the retaining loops 71, 72, so that the keyholes 72 are not covered by the seat fabric material 14 when the retention loop 71 is fitted over the bar 70, as is shown in FIG. 7. Once the loop 71 is fitted over the bar 70, the cylindric bores of the keyholes 72 are fitted over the heads of the studs 73. Then the bar 70 is moved downwards to the position shown in FIG. 7, with the stud heads engaging the slot portions of the keyholes 72. The seat material 14 is thereby held firmly and throughout its width by the bars 70 upon the support members 16 and 17. As shown in detail in FIG. 8, the bars 16 and 17 are fastened as by one or more rivets 75 to the frame members. The ends of the bars 16 and 17 are attractively beveled and capped as at 76.

Various other forms of structure can be employed without departing from the scope of the present invention. For instance the lower cross pieces 20, 30 may be dispensed with in favor of straight legs and separate feet and other cross-supports. Other forms of frame than bent metal tubing may be used. Other forms of pivot links than that shown may be devised. The present invention is limited only by the scope of the appended claims and equivalents thereof.

I claim as my Invention:

1. A folding chair having a seat, a back rest, supporting legs which are crossed and pivotably connected together at the sides, and arm rests carried above the level of the seat, wherein each arm rest extends between a pivot at a front side of the chair and a link means for pivotally engaging said arm rest and supporting the arm rest with respect to one of the supporting legs, the arm rests in an open position of the chair being fixed by said link means in a position generally above the seat and in a folded position of the chair hanging from said pivots behind and below the back rests and via the link means locking the chair into said folded position.

2. A folding chair as defined in claim 1, wherein the chair comprises a first frame carrying said back rest and a rear portion of the seat; a second frame carrying a front portion of the seat and each said pivot; and a third frame connected to each said pivot and said link means, the first and second frames including said legs and the third frame including said arm rests.

3. A folding chair as defined in claim 2, wherein said link means comprises at least one elongated, rigid link with opposite first and second ends, the first end pivotally engaging and carried by said first frame and the second end pivotally engaging and carried by said third frame, the link means controlling and facilitating movement of the frames between the open position of the chair and the folded position and vice versa.

4. A folding chair as defined in claim 3, wherein said link has a length and its second end engages the arm rest in a position about twice the length of said link rearwardly of said front pivot.

5. A folding chair as defined in claim 3, wherein the first end of said link engages the first frame at a point adjacent said seat in the open position of said chair and the second end of the link engages the arm rest in a position vertically forwardly of the position of the first end of said link in the open position of the chair.

6. A folding chair as defined in claim 1, wherein in the open position of the chair the link means is inclined forwardly of the chair.

7. A folding chair as defined in claim 6, wherein the link means is inclined within about 30° of the vertical.

8. A folding chair as defined in claim 6, wherein the link means is inclined within about 10° of the vertical.

9. A folding chair as defined in claim 1, in which the link means is substantially straight.

10. A folding chair as defined in claim 1, wherein the link means has a lower end and said lower end engages the first frame at a point gravitationally below the level of the seat at its rear attachment to the first frame.

11. A folding chair as defined in claim 2, wherein the seat comprises a fabric material and the material is formed with loops at its forward and rearward portions, said first and second frames further comprise cross pieces affixed thereto and extending transversely of the chair, a retention bar received each of said loops, and engagement means between each retention bar and the respective cross piece for removably engaging and retaining each said bar on said cross piece, whereby to support said seat thereon.

12. A chair foldable between an open position for use and a folded position for storage, comprising only three frame members, a seat and a back rest carried on said frame members, and a pair of control links, the chair comprising:

a first frame member extending from a front lower part of the chair, diagonally upwardly along the sides of the chair, and upwardly at the rear of the chair and carrying the back rest, and including a cross piece supporting a rear portion of the seat;

a second frame member extending from a rear lower part of the chair, diagonally upwardly along the sides of the chair, and upwardly at the front of the chair and including a cross piece supporting a front portion of the seat, and the second frame being pivotally joined to the first frame member at centers of the diagonal parts of each;

a third frame member pivotally joined to the second frame member above the seat at the front of the chair and extending in the open position behind the back rest and in the closed position hanging downwardly from the second frame behind the chair; and a pair of rigid connecting links each having a first end pivotally joined to the first frame adjacent the rear cross piece thereof and a second end pivotally joined to the third frame, the connecting links connecting and supporting the third frame in spaced relation to the first frame in the open position and in all partly and fully folded positions.

13. A folding chair as defined in claim 12, wherein each of the control links has a length and engages the third frame member at a point located about 1.7 to two times the length of the link rearwardly of the point of pivotal joining of the third frame member to the second frame member.

14. A folding chair as defined in claim 12, wherein in the open position of the chair the link is inclined forwardly of the chair between about 2° and about 30° of the vertical.

15. A folding chair as defined in claim 12, wherein each of said control links is engaged at its first end with the first frame member at a point below the rear portion of the seat.

16. A folding chair as defined in claim 12, wherein each of the front and rear portions of the seat is formed with a transverse loop of seat material, and each said cross piece comprises a retaining bar removably received in said loop, the bar being removably engaged with said cross piece.

17. A folding chair having a front, a rear, and sides and being foldable between an open position for use and a closed position for storage, the chair comprising:

a seat having a front edge and a rear edge and side edges extending between the front and rear edges;

a back rest having a lower edge and a top edge and side edges extending between the lower and top edges;

a first frame comprising:

a front lower cross piece extending from one side of the chair to the other and generally parallel to the front edge of the seat and spaced a distance below said front edge in the open position of the chair, a pair of lower side pieces affixed to the front lower cross piece and extending diagonally upwardly and rearwardly therefrom at the sides of the chair to the rear edge of the seat, a pair of upper rear side pieces each affixed to the corresponding lower side pieces and extending upwardly along the side edges of the back rest to the top edge of the back rest, and a rear cross piece extending between the junctions of the lower and upper side pieces at either side of the chair and supporting the rear edge of the seat;

a second frame comprising:

a rear lower cross piece extending from one side of the chair to the other generally parallel to the rear edge of the seat and spaced a second distance therebelow in the open position of the chair, a pair of lower side pieces affixed to the rear lower cross piece and extending diagonally upwardly and forwardly therefrom at the sides of the chair to the front edge of the seat, a pair of upper side pieces each affixed to the corresponding lower side piece and extending upwardly to a free end, and a front cross piece extending between the junctions of the lower and upper side pieces at either side of the chair and supporting the front edge of the seat, and wherein each of the corresponding lower side pieces of the first and second frames are pivotally joined to one another at approximately the middle of each, whereby the first and second frames in the open position have their lower cross pieces and the front or rear, seat-supporting cross pieces spaced apart at distances less than the corresponding spacing distances in the closed position of the chair;

a third frame comprising:

a pair of elongated side pieces each pivotally joined at one end thereof to one of the free ends of the upper side pieces of the second frame and extending along and generally parallel to a side edge of the seat in the open position of the chair and slidably engaged with the upper rear side pieces of the first frame in the open position, and a rear cross piece affixed to the ends of the side pieces and extending across the chair behind the back rest in the open position of the chair; and a pair of rigid control links each having first and second ends, said first ends pivotally engaging said first frame member adjacent said seat and said second end pivotally engaging and supporting said third frame in the open position of the chair.

18. A folding chair as defined in claim 17, wherein each of the pair of rigid control links has a length and wherein the second ends thereof are pivotally joined to the third frame at a distance of about two times the length of the link rearwardly of the point of its pivotal joining with the free ends of the upper side pieces of the second frame.

19. A folding chair as defined in claim 17, wherein each of said pair of rigid control links extends slightly forward of vertically from the first frame and the second end of the links in the open position of the chair.

20. A folding chair as defined in claim 19, wherein each of the pair of rigid control links extends at less than about 30° from the vertical.

21. A folding chair as defined in claim 19, wherein each of the pair of rigid control links extends at less than about 10° to the vertical.

* * * * *